US006352043B1

(12) United States Patent
Tajima et al.

(10) Patent No.: US 6,352,043 B1
(45) Date of Patent: Mar. 5, 2002

(54) SEWING MACHINES HAVING MULTIPLE-INDIVIDUALLY CONTROLLABLE NEEDLE BARS

(75) Inventors: Ikuo Tajima; Masaru Akao; Yuji Sato, all of Kasugai (JP)

(73) Assignee: Tokai Kogyo Mishin Kabushiki Kaisha, Kasugai (JP)

( * ) Notice: Subject to any disclaimer, the term of this patent is extended or adjusted under 35 U.S.C. 154(b) by 0 days.

(21) Appl. No.: 09/630,792

(22) Filed: Aug. 2, 2000

(30) Foreign Application Priority Data

Aug. 3, 1999 (JP) ..... 11-220390

(51) Int. Cl.[7] ..... D05B 1/08; D05B 55/16; D05C 5/02

(52) U.S. Cl. ..... 112/102.5; 112/163; 112/470.04; 112/475.19

(58) Field of Search ..... 112/102.5, 470.04, 112/470.06, 155, 163, 164, 165, 166, 167, 475.19; 700/136, 137, 138

(56) References Cited

U.S. PATENT DOCUMENTS 5,603,272 A * 2/1997 Takahashi et al. ..... 112/163
6,012,402 A * 1/2000 Sekine ..... 112/102.5
6,123,037 A * 9/2000 Shimizu ..... 112/102.5

* cited by examiner

*Primary Examiner*—Peter Nerbun
(74) *Attorney, Agent, or Firm*—Lyon & Lyon LLP

(57) ABSTRACT

A sewing machine includes a plurality of needle bars. One of the needle bars can be selected and reciprocally driven so as to stitch a desired embroidery pattern. The sewing machine has a common setting mode and an individual setting mode, which permits various operating conditions to be either commonly set for all the needle bars or individually set for one or more of the needle bars. If the common setting mode has been selected, the same operating conditions can be commonly set for all the needle bars. If the individual setting mode has been selected, the operating conditions can be set individually for each needle bar.

24 Claims, 12 Drawing Sheets

SEWING MACHINES HAVING MULTIPLE-INDIVIDUALLY CONTROLLABLE NEEDLE BARS

BACKGROUND OF THE INVENTION

1. Field of the Invention

The present invention relates to sewing machines having one or more sewing heads, each sewing head having a plurality of needle bars. More particularly, the present invention relates to sewing machines in which operating parameters or conditions for each of the needle bars can be individually set.

2. Description of the Related Art

Known multi-needle sewing machines have a sewing head with a plurality of needle bars. Threads having different characteristics (such as color, thickness, smoothness and/or elasticity) are set on each of the respective needle bars. The operator can select any one of the needle bars to be driven, so that the sewing operation can be performed using the different kinds of threads. As a result, embroidery products can be automatically stitched with variations in color, thickness and/or texture.

In general, this type of sewing machine is designed such that the operator can set various operating conditions or parameters before the sewing operation is initiated. Such operating conditions may include, for example, "thread cutting length," "number of inching times," and "accuracy in detection of thread cut threads." In this specification, the term "thread cutting length" means the length of the upper thread that extends from the needle bar after the upper thread has been intentionally cut by the sewing machine. The term "number of inching times" means the number of times that the needle bar is reciprocated at a speed that is less than the normal sewing operation speed. An "inching" operation is usually performed after the thread has been cut and a sewing operation is initiated with a new thread. In order to minimize the possibility that the thread will pull out of the fabric, the needle bar is first reciprocated at a slow speed when the sewing machine begins to stitch with the new thread in order to set the thread in the fabric. After a predetermined number of slow stitches (i.e. predetermined number of "inching times"), the needle bar begins to reciprocate at the normal operating speed in order to complete the embroidery operation.

Known multi-needle sewing machines have been designed such that operating conditions or parameters can only be commonly set for all the needle bars of the sewing head. As a result, it is not possible to individually adjust the sewing operation in response to differing characteristics of the threads that are set on each of the needle bars.

SUMMARY OF THE INVENTION

It is, accordingly, one object of the present invention to teach improved sewing machines, in which the sewing operation can be suitably adjusted in response to differing characteristics of the threads that are set on the needle bars.

According to the present teachings, improved sewing machines are taught in which operating conditions or parameters can be individually set for different needle bars on the same sewing head. Thus, a first needle bar can operate using a first set operating conditions or parameters and a second needle bar on the same sewing head can operate using a second set of operating conditions or parameters.

In addition, sewing machines are taught in which the operating conditions or parameters can be individually set for each of the respective needle bars on a sewing head, or the same operating conditions or parameters can be utilized for all the needle bars on the sewing head. Preferably, the operating condition can be set by selecting either a common setting mode for setting the same operating conditions for all the needle bars or an individual setting mode for setting different operating conditions for the respective needle bars.

Other objects, features and advantages of the present invention will be readily understood after reading the following detailed description together with the accompanying drawings and the claims.

DETAILED DESCRIPTION OF THE INVENTION

Figure 1:
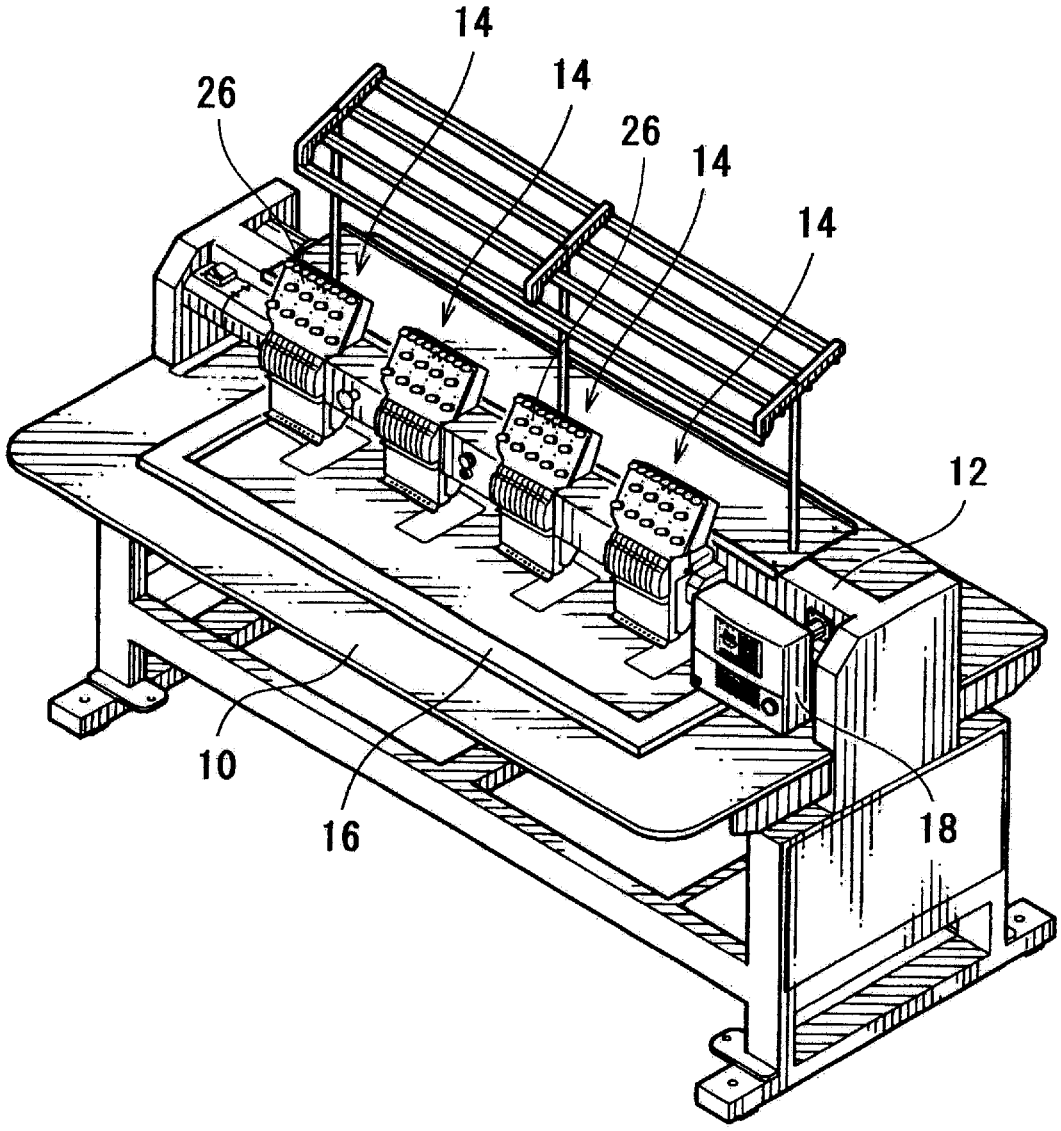
FIG. 1 is a perspective view of a representative multi-needle sewing machine.

A sewing machine may include one or more sewing heads and each of the sewing heads preferably has a plurality of needle bars. A controller (or processor) and at least one memory device may be utilized to control the operation of each of the needle bars. The memory device may store an operating program and operating conditions or parameters for the sewing machine. Preferably, the memory device may store operating conditions or parameters that are individually set for each needle bar. In addition, the memory device also may store operating conditions or parameters that are commonly set for all the needle bars. The controller may operate the needle bars based on either operating conditions that are commonly set for all the needle bars or operating conditions that are individually set for each of the needle bars. More specifically, the controller may preferably select one of the needle bars according to the operating program stored in the memory device and perform the sewing operation according to the specific operating conditions for the selected needle bar that are stored in the memory device.

The sewing machine may further include a display, which may enable an operator to manually set the operating conditions. The display may also display a common setting image for the operating conditions and an individual setting image for the operating conditions. The operating conditions set using the common setting image can be stored in the memory device as common operating conditions for all the needle bars. The operating conditions set using the individual setting image can be stored in the memory device as operating conditions for each of the respective needle bars.

The display device may preferably display a menu selection area that shows various items corresponding to various operating conditions. The display may display the common setting image and the individual setting image for each item that has been selected in a menu selection area.

The common setting image may include, for example, an identification of the operating conditions that have been commonly set for all the needle bars. In addition, the individual setting image may include, for example, icons that represent the respective needle bars and an identification of the operating conditions that have been set individually for each needle bar.

Furthermore, each common setting image for the operating conditions and each individual setting image for the operating conditions may include, for example, an identification of one or more items that can be commonly set by the operator and one or more items that can be individually set by the operator. The common setting image may be displayed when the operator selects a common setting mode. The individual setting image may be displayed when the operator selects the individual setting mode.

A representative example of the present teachings will now be described in detail with reference to the attached drawings. This detailed description is merely intended to teach person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention.

Figure 2:
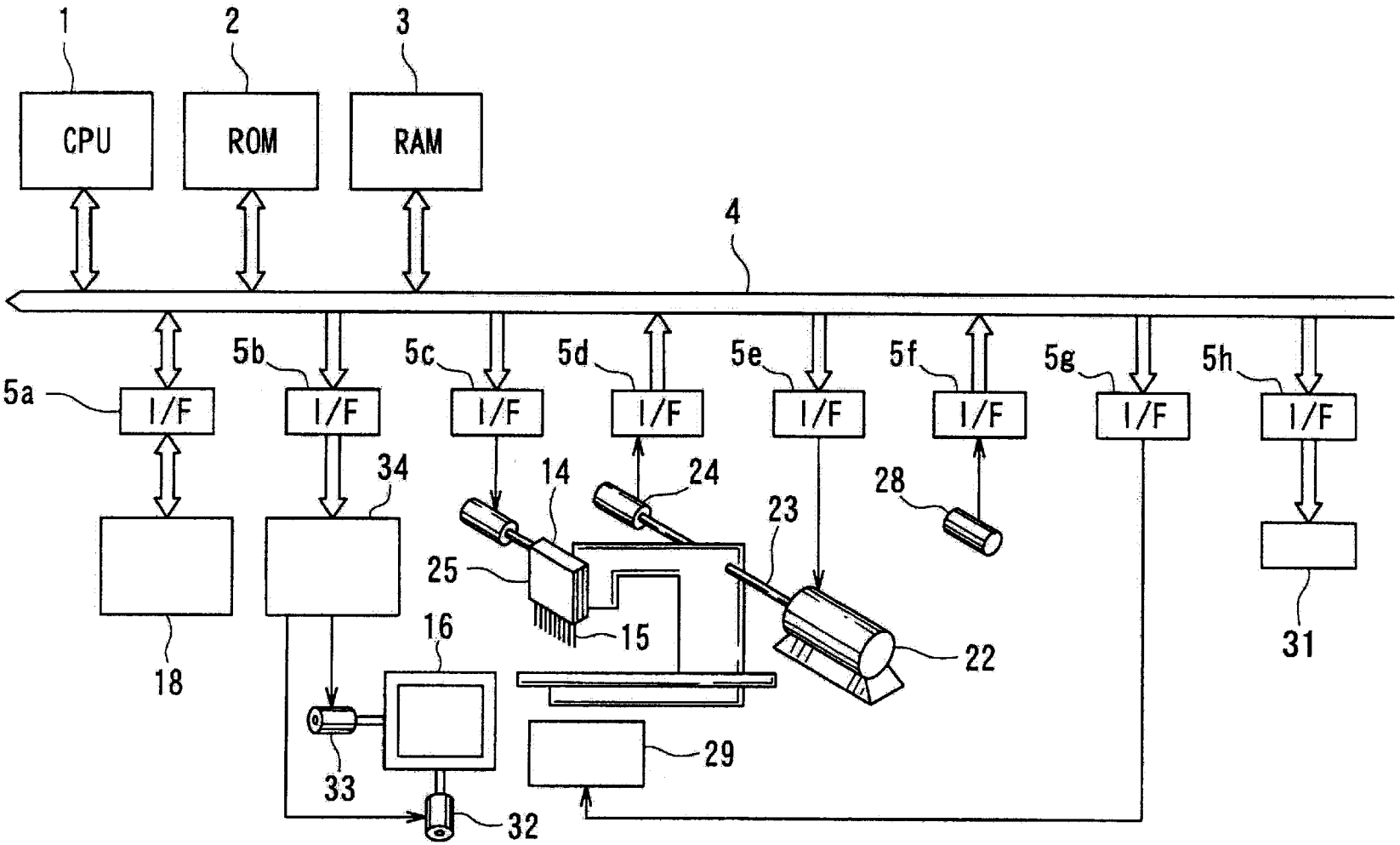
FIG. 2 is a schematic diagram of the representative sewing machine.

FIG. 1 illustrates a perspective view of a representative multi-head/multi-needle sewing machine that may include a plurality of sewing heads, each sewing head having a plurality of needle bars. The sewing machine may include a machine table 10, a support frame 12 that extends above the machine table 10, and a plurality of sewing heads 14 (four sewing heads are shown in the representative embodiment) that are mounted on the support frame 12 and are spaced equally from each other in the longitudinal direction of the support frame 12. As schematically shown in FIG. 2, each of the sewing heads 14 may include a plurality of needle bars 15 (nine needle bars are shown in FIG. 2). For each of the sewing heads 14, one of the needle bars 15 can be selected at a time to stitch a fabric or other material.

The selected needle bar 15 can be vertically reciprocally driven by a drive mechanism (not shown) in synchronism with movement of other parts that cooperate with the needle bar to perform the sewing operation. The fabric or other material to be embroidered may be stretched on and supported by an embroidery frame 16 disposed below the sewing head 14. In the alternative, a cylindrical fabric or cap may be stitched using a cylindrical fabric holder as taught, for example, in U.S. Pat. No. 5,553,560, the teachings of which are incorporated herein by reference.

An X-axis motor 32 and a Y-axis motor 33 may move the embroidery frame 16 in an X-axis direction and a Y-axis direction, respectively, relative to the table 10. As a result, while moving the embroidery frame 16 in the X-axis and Y-axis directions, an embroidery pattern can be formed on the fabric as the selected needle bar 15 and its cooperating parts are driven.

An operator interface 18 also may be mounted on the support frame 12. The operator can manually set various operating conditions or parameters using the operator interface 18 including, for example, machine operating conditions for performing the sewing operation. In the alternative, operating programs or operating conditions can be input to the sewing machine using, for example, a CD-ROM, a floppy disk or other memory media, instead of directly and manually inputting such information into the operator interface 18. Thus, the operator interface 18 also may preferably include a means for reading information storied on a CD-ROM, floppy disk or other memory media.

As shown in FIG. 2, a control system may primarily include a controller such as a central processing unit (CPU) 1, a read-only memory (ROM) 2 for storing embroidering programs or other programs, a read-only memory (RAM) 3 for storing various data, such as machine operating conditions, and the operator interface 18. The CPU 1, the ROM 2 and the RAM 3 may be connected to a bus line 4. The operator interface 18 may be connected to the bus line 4 by means of an interface (I/F) 5*a*. Various other hardware architectures may be utilized with the present teachings in order to operate the needle bars 15 according to commonly set operating parameters or individually set operating parameters.

A main motor 22 may rotate a main drive shaft 23 that drives the needle bars and the other movable parts of the sewing heads, which parts may cooperate with the respective needle bars to perform the sewing operation. A position detector 24, such as a rotary encoder, may detect the rotational position of the main drive shaft 23, so that the vertical position of the needle bars 15 can be determined based upon output signals from the position detector 24. A needle selecting device 25 may be utilized to select one of the needle bars 15 to be vertically driven by sewing head 14.

Upper threads, which may have different characteristics from each other, may be supplied from their respective upper thread supply devices 26 shown in FIG. 1 to the needle bars 15 of each sewing head 14. Upper thread feeding amount detectors 28 (only one shown in FIG. 2) may detect the amount of upper thread that has been fed from the upper thread supply devices 26 to the corresponding needle bars 15. For example, each of the feeding amount detectors 28 may include a roller and a pulse generator (not shown). The roller may engage the upper thread that is fed from the corresponding upper thread supply device 26 to the needle bar 15, so that the roller rotates as the upper thread is fed to the selected needle bar 15. The pulse generator may be coupled to the roller so as to output pulses in proportion to the rotational speed of the roller. In the alternative, the upper thread feeding amount detectors 28 may directly detect the feeding speed of the upper threads. Lower threads may be fed from their respective lower thread supply devices, which may include bobbins mounted within shuttles. Each sewing head 15 may include a picker device 29 that can serve to adjust the cutting length of the upper thread. The main motor 22, the position detector 24, the feeding amount detectors 28 and the picker devices 29 may be connected to the bus line 4 via I/Fs 5*c* to 5*g*, respectively.

The X-axis motor 32 and the Y-axis motor 33 for moving the embroidery frame 16 relative to the machine table 10 may be controlled by a motor controller 34 that is connected to the bus line 5*b* via an I/F 5*b*.

A thread cutting device 36 may be associated with each sewing head 15 so as to cut the upper thread and/or the lower thread when the sewing operation has been completed. The thread cutting device 36 may be connected to the bus line 4 via I/F 5*h*.

The CPU 1 may control various parts of the sewing machine, including but not limited to the needle selecting device 25, the main motor 22, the picker device 29, the X-axis motor 32, the Y-axis motor 33 and the thread cutting device 36.

Figure 3:
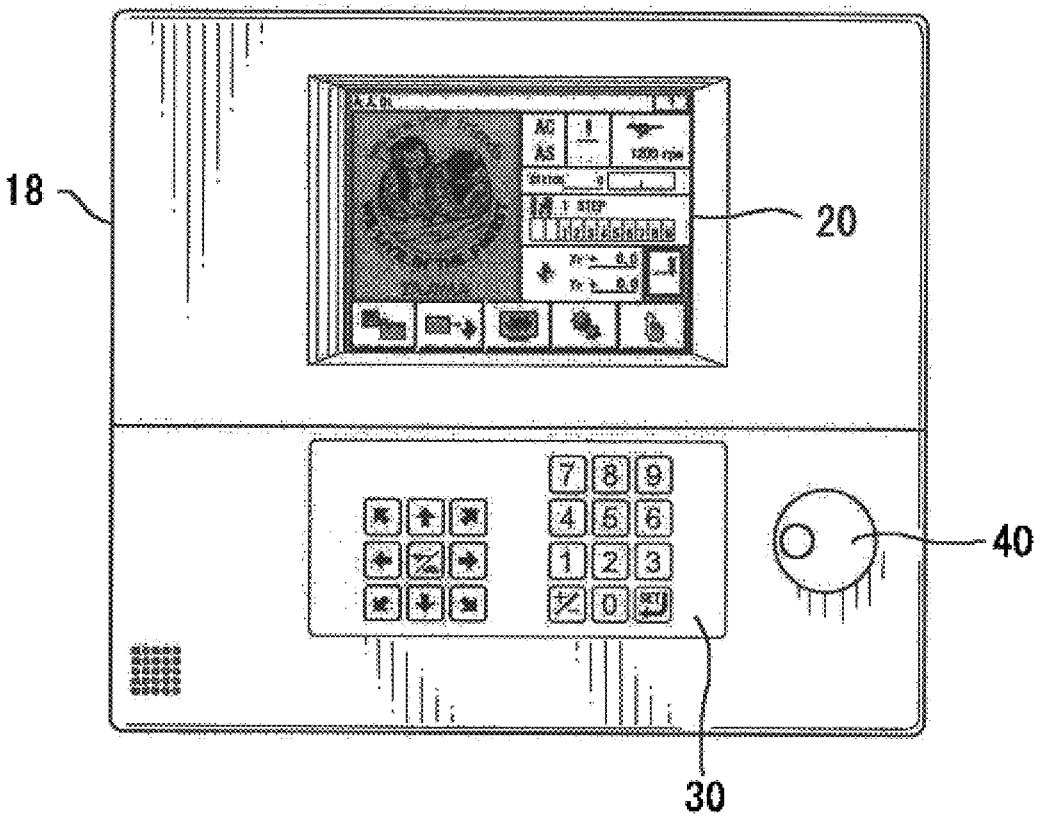
FIG. 3 is a front view of a representative control box panel.

A representative apparatus for setting various machine operating conditions will now be described. The operating conditions may be set using the operator interface 18. A front view of the operator interface 18 is shown in FIG. 3. The operator interface 18 may include a display, such as an LCD 20, a key pad 30 and a jog dial 40. The key pad 30 may include alphanumerical keys and arrow keys. A touch sheet (not shown) preferably may be attached to the front surface of the LCD 20 to permit the operator to input pattern selections, operating conditions and other information by pressing portions of the LCD 20 showing figures, icons or characters that represent certain embroidery patterns, operating conditions or other information. However, various devices for manually selecting embroidery patterns, operating conditions or inputting data may be utilized with the present teachings.

Figure 4:
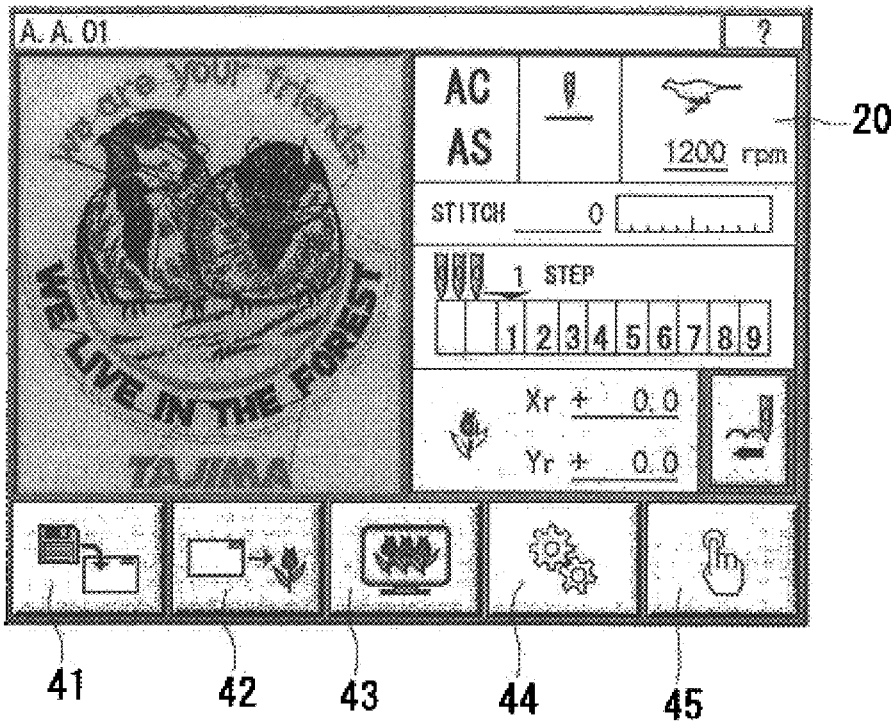
FIG. 4 is a view of a representative main image of an LCD.

FIG. 4 illustrates a "Main" page or image that may be initially displayed on the LCD 20. Five touch switches 41 to 45 may be displayed on the lower side of the "Main" image and may serve as main menu keys. When the operator selects any one of the touch switches 41 to 45 (by pressing the area of the LCD that corresponds to the touch switch), the next image that corresponds to the selected touch switch may be displayed on the LCD 20. More specifically, the following images (a) to (e) may be displayed on the LCD 20 when the touch switches 41 to 45 are selected, respectively.

(a) Image Appearing After Selection of Touch Switch 41

"Data Input" image that enables the operator to input data from external devices, such as a CD-ROM or a floppy disk.

(b) Image Appearing After Selection of Touch Switch 42

"Data Input" image that enables the operator to manually input data into the operator interface 18.

(c) Image Appearing After Selection of Touch Switch 43

"Pattern Data Control" image that enables the operator to input changes to the embroidery pattern data.

(d) Image Appearing After Selection of Touch Switch 44

"Mechanical Setting Control" image that enables the operator to set machine operating conditions.

(e) Image Appearing After Selection of Touch Switch 45

"Manual Operation Image" that enables the operator to manually operate the sewing machine.

When the "Pattern Data Control" image has been displayed by selecting touch switch 43, the operator can, for example, (1) write or erase embroidery pattern data, (2) output embroidery pattern data to an external device, and/or (3) edit the embroidery pattern data (data for each pattern or each stitch). When the "Mechanical Setting Control" image has been displayed by selecting touch switch 44, the operator can set various operation parameters, such as "Jump Convert," "Auto Jump," "Satin Stitch," "High Rotational Speed," "Low Rotational Speed," Method of Frame Leaping," "Auto Origin Return," "Start Timing of Movement of Frame," "Start Inching," and "Start Inching After Thread Cutting." When the "Manual Operation Image" has been displayed by selecting touch switch 45, various commands can be manually input. Such commands may include, but are not limited to, commands for cutting threads, moving a presser foot, performing stitch back or stitch forward, actuating a bobbin changer, raising or lowering table 10, and/or moving embroidery frame 16.

In addition, when the "Mechanical Setting Control" image displays a needle bar page, the operator can select either a "Common Setting" mode or an "Individual Setting" mode for some or all of the machine operation parameters. In the "Common Setting" mode, the operator can set the same operation parameters for all the needle bars. In the "Individual Setting" mode, the operator can set particular operation parameters for each needle bar.

Figure 5:
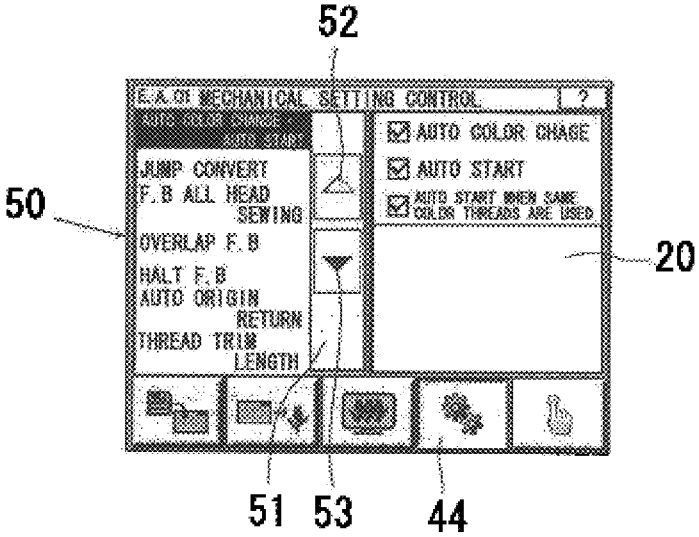
FIG. 5 is a view of a representative image for an initial setting mode.

Thus, when the "Main" image is displayed and the operator selects the touch switch 44, as shown in FIGS. 3 and 4, an "Initial Setting" image may be displayed as shown in FIG. 5. In order to indicate that the touch switch 44 has been selected, the image of the touch switch 44 may be converted into a highlighted or an image in which touch switch 44 appears to have been depressed. However, other methods can be used to indicate the selection of the touch switch 44.

As shown in FIG. 5, the "Initial Setting" image may include a "Menu Selection" area 50 on the left side. By selecting (or pressing) either one of the items shown in "Menu Selection" area 50, a specific image for the selected item may be displayed. In order to see the desired item among the items included in "Menu Selection" area 50, the operator can scroll up and down "Menu Selection" area 50 by means of a vertical scroll bar 51. For example, arrow keys 52 and 53 can be used to select the scrolling direction.

A representative process for setting various operating conditions or parameters of the sewing machine will now be explained.

1. Thread Cutting Length

The term "Thread Cutting Length" means the length of the remaining part of the upper thread that extends from the needle bar 15 (or more specifically the length of thread that extends from the sewing needle attached to needle bar 15) to the end of the upper thread after it has been cut by the thread cutting device 36. Preferably, the cutting length can be changed in response to the specific embroidery pattern that will be stitched or the type of fabric that will be embroidered in the next embroidering operation. In general, in order to cut an upper thread (and/or a lower thread) when the sewing operation is completed, a movable knife of the thread cutting device 36 moves to cut the thread(s) in relation to the movement of a sewing needle, which cooperates with a shuttle to form the stitches. The picker device 29 may have a thread picker that can move toward and away from a shuttle for engaging and disengaging the upper thread in response to the movement of the sewing needle. After the movable knife has moved to cut the thread, the cut end of the upper thread may be retained by a retainer associated with the thread cutting device 36, so that the upper thread may be pulled out from the upper thread supply device with a part of the upper thread engaged by the thread picker. Thereafter, the thread picker may retract from the shuttle to disengage the upper thread. Therefore, the cut length of the remaining part of the upper thread can be varied by changing the time at which the thread picker is retracted. Alternatively, the upper thread may be cut after the upper thread has been disengaged from the thread picker. Thus, the time of the thread cutting may be appropriately determined before or after disengagement of the upper thread by the thread picker in response to the cutting length.

Figure 6:
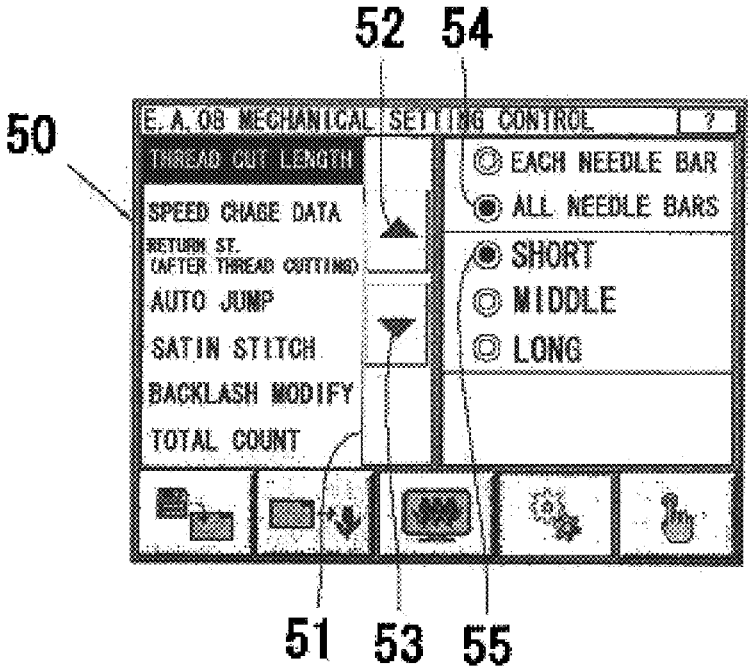
FIGS. 6(A) and 6(B) are views of representative images for a thread cutting length setting mode.
Figure 6:
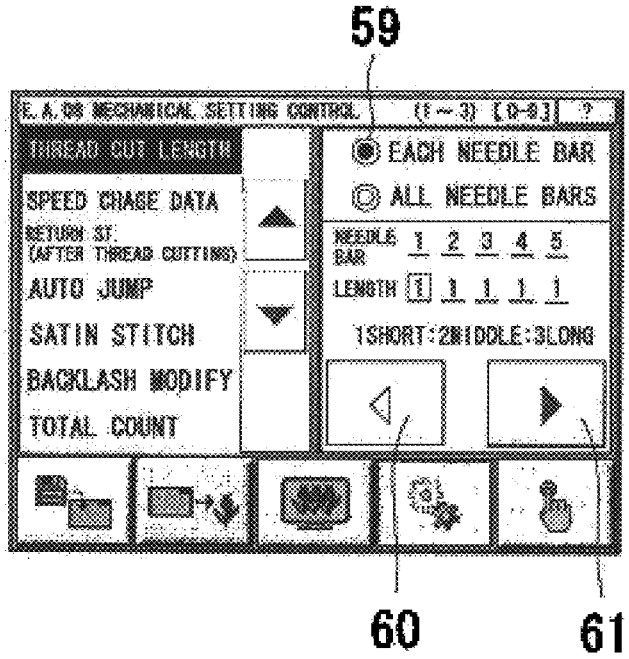

In order to set the cut length using the "Initial Setting" image shown in FIG. 5, the operator scrolls to the "Menu Selection" area by means of the arrow keys 52 and 53 of the vertical scroll bar 51 so as to display the item "Thread Cutting Length." Then, the "Thread Cutting Length" item is selected (e.g., by pressing the area of the display in which this item is displayed) and an image for setting the "Thread Cut Length" may be displayed, as shown in FIGS. 6(A) and 6(B). In order to indicate that the item "Thread Cutting Length" has been selected, this item may be highlighted in the image. Again, other methods can be used to indicate the selection of the item "Thread Cutting Length."

FIG. 6(A) shows an image for setting the "Thread Cut Length" in which the "Common Setting" mode has been selected for the needle bars. Thus, the cutting length can be set to have the same length for all the needle bars. In order to indicate that the "Common Setting" mode has been selected, a radio button 54 next to the item "All Needle Bars" may flash green in this image while setting the "Thread Cut Length". In addition, one of radio buttons 55 next to items "Short," "Middle" and "Long," which represent three different thread cutting lengths, may flash to indicate the selected set value. In the image for setting the "Thread Cut Length" shown in FIG. 6(A), the radio button 55 next to the item "Short" will flash green. On the other hand, if the operator selects the item "Each Needle Bar" while using the image for setting the "Thread Cut Length," the image will change from the image shown in FIG. 6(A) to the image shown in FIG. 6(B).

In the image for setting the "Thread Cut Length" shown in FIG. 6(A), the operator can commonly set the thread cutting length for all the needle bars. In order to select the thread cutting length, the operator may press one of the displayed items "Short", "Middle" and "Long" that represent a short cutting length, a middle cutting length and a long cutting length, respectively. As a result, the radio button 55 next to the selected item may flash green. The selected length can thus be commonly set for all the needle bars and this operating parameter may be stored in RAM 3. In order to return from the image for setting the "Thread Cut Length" to the "Main" image, the operator selects or presses touch switch 44. In that case, the image of the touch switch 44, which appeared depressed, may return to the original image.

FIG. 6(B) shows the image for setting the "Thread Cut Length" in which the "Individual Setting" mode (i.e., "Each Needle Bar") has been selected for the needle bars. Thus, the thread cutting length can be set for each needle bar. In order to indicate that the "Individual Setting" mode has been selected, a radio button 59 next to at the item "Each Needle Bar" may flash green. When the operator selects the item "All Needle Bars" in the image for setting the "Thread Cut Length," the display changes from the image shown in FIG. 6(B) to the image shown in FIG. 6(A).

In the image for setting the "Thread Cut Length" shown in FIG. 6(B), each of the needle bars also are displayed (e.g., by numerals "1, 2, 3, 4, 5") in relation to the item "Needle Bar." In FIG. 6(B), numerals "1" to "5" are displayed to identify the respective needle bars. Numerals "6" to "9" corresponding to the remaining needle bars are not displayed in this image and instead may appear by pressing arrow key 60 or 61. The number of needle bars that are displayed in each image may be determined by various conditions, such as the size of the display and the amount of any ancillary information that is also displayed.

Item "Length" also is displayed below the item "Needle Bar." Numerals "1," "2" and "3" also may be displayed in relation to that item in order to represent a "Short Cutting Length," a "Middle Cutting Length" and a "Long Cutting Length," respectively. A definition of the numerals "1," "2" and "3" also may be displayed below the item "Length," as shown in FIG. 6(B).

In order to individually set the cutting length for each needle bar 15 using the image for setting the "Thread Cut Length" shown in FIG. 6(B), the operator may select one of the needle bars by means of the arrow key 60 or 61. In that case, numeral "1," "2" or "3," which represents the cut length and is positioned below the numeral (one of "1" to "9") identifying the selected needle bar, may be highlighted. While the numeral representing the cut length of the selected needle bar is highlighted, the operator selects the numeral (i.e., "1," "2" or "3") that represents the desired thread cut length by using corresponding keys in the alphanumerical key pad 30. This operation is repeated for all the needle bars and the thread cutting length can be individually set for each needle bar. The thread cutting length data set by this operation may be stored in RAM 3. The operator can then return to "Main" image by selecting or pressing touch switch 44.

Figure 10:
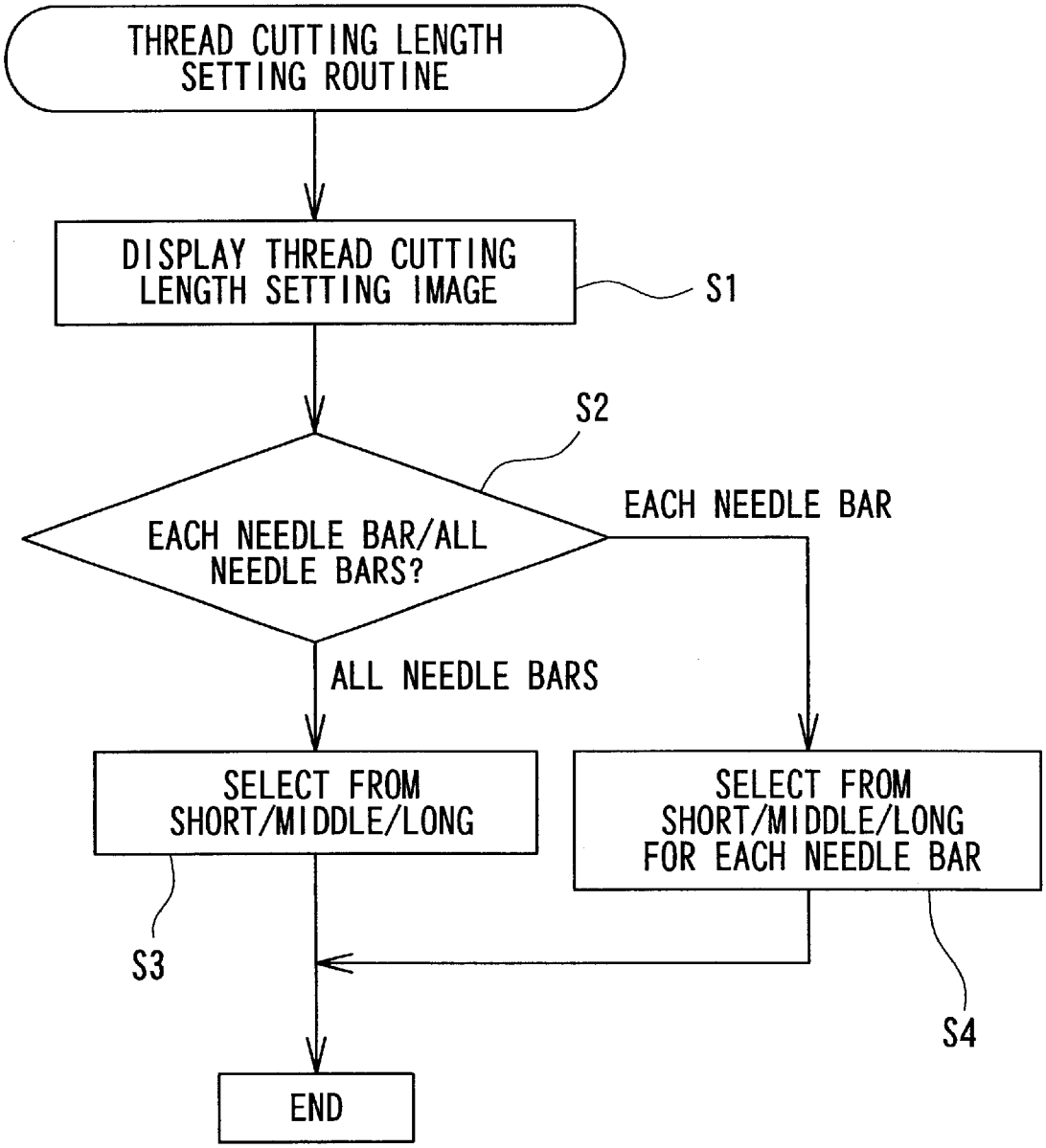
FIG. 10 is a representative flowchart illustrating a thread cutting length setting process.

The above-described process for setting the cutting length will now be explained in connection with the representative flowchart shown in FIG. 10.

When the item "Thread Cutting Length" is selected in the "Menu Selection" area 50 of the "Main" image, CPU 1 commands the LCD 20 to change the displayed image to either the image for setting the "Thread Cut Length" shown in FIG. 6(A) or the image for setting the "Thread Cut Length" shown in FIG. 6(B) in response to the operating parameter for the thread cutting length that is stored in RAM 3. The CPU 1 then initiates the thread cutting length setting process (Step S1).

First, the CPU 1 determines whether the item "All Needle Bars" has been selected to indicate the common setting mode or whether the item "Each Needle Bar" has been selected to indicate the individual setting mode (Step S2).

If "All Needle Bars" has been selected, CPU 1 commands LCD 20 to display the image for setting the "Thread Cut Length" as shown in FIG. 6(A). On the other hand, if "Each Needle Bar" has been selected, CPU 1 commands LCD 20 to display the image for setting the "Thread Cut Length" as shown in FIG. 6(B). If the operator has not yet selected either "All Needle Bars" or "Each Needle Bar," CPU 1 utilizes a default setting condition for the image for setting the "Thread Cut Length."

If "All Needle Bars" has been selected, a value for the thread cutting length may be input (by selecting one of the items "Short", "Middle" and "Long" in the displayed image) and the input data is stored in the RAM 3 as a set value for the thread cutting length for all the needle bars (Step S3).

On the other hand, if "Each Needle Bar" has been selected, one of the needle bars is selected and the setting value for the thread cutting length is input for the selected needle bar. Again, the inputted data is stored in the RAM 3 as a set value for the thread cutting length for the selected needle bar (Step S4). This step may be repeated for each of the remaining needle bars.

Naturally, various other methods for setting other operating conditions may also be performed in the same manner as the process described with reference to FIG. 10.

2. Start Inching

In general, when the sewing operation is restarted after the thread has been cut, the reciprocal movement of the needle bar is "inched," i.e., the needle bar is reciprocated at a speed less than the normal reciprocating speed, for a predetermined number of strokes at the beginning of the sewing operation. "Inching" usually prevents accidental withdrawal of the thread from the fabric (improper start of the sewing operation). Preferably, the number of times that the needle bar 15 is "inched" can be varied in response to the properties of the thread or the fabric to be sewn. For example, if a smooth thread is used, such as a thin thread or an artificial fiber thread, the number of times that the needle bar is inched must be increased as compared to normal threads.

Figure 7A:
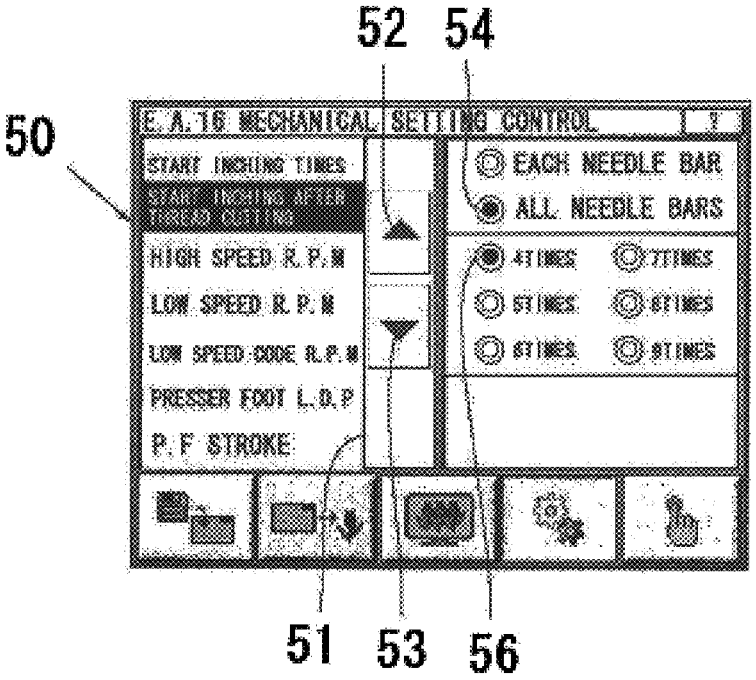
FIGS. 7(A) and 7(B) are views of representative images for a setting mode for setting a number of inching operations after thread cutting.
Figure 7B:
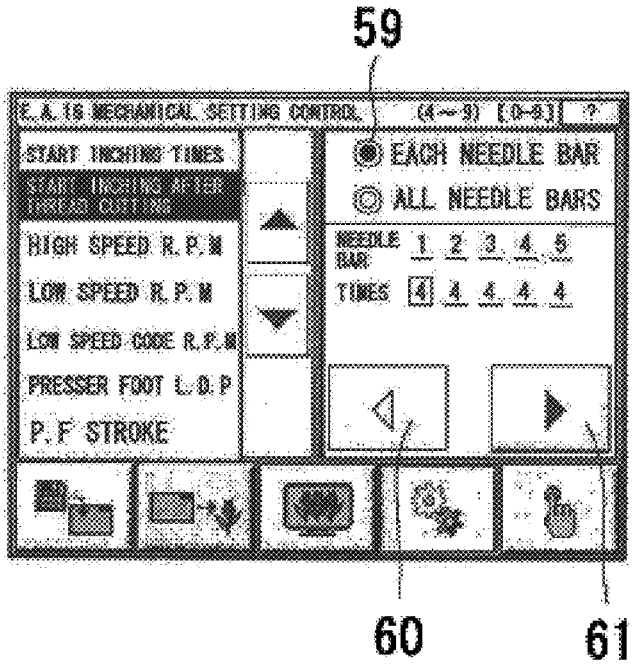

In order to set the number of times that the needle bar is inched, the operator may scroll through the "Menu Selection" area 50 in the "Initial Setting" image shown in FIG. 5. Using arrow key 52 or 53 of the scroll bar 51, the item "Start Inching" may appear. Then, the operator selects the item "Start Inching". As a result, an image for selecting the number of times that the inching operation will be performed may be displayed, as shown in FIG. 7(A) or FIG. 7(B). The item "Start Inching" may be highlighted to indicate that the item "Start Inching" has been selected.

In the inching selection image shown in FIG. 7(A), the "Common Setting" mode has been selected in order to set the same number of inching times for all the needle bars. In order to indicate that the "Common Setting" mode has been selected, the radio button 54 next to the item "All Needle Bars" may flash green. In addition, various other inching parameters, which can be set by the operator, may be displayed. In the representative embodiment shown in FIG. 7(A), "4 Times" to "9 Times" may be displayed with corresponding radio buttons 56. In this case, the radio button 56 that corresponds to the selected number of times may flash green. In the image shown in FIG. 7(A), "4Times" has been selected, so that the corresponding radio button 56 flashes green. However, if the operator selects the item "Each Needle Bar" in the inching selection image shown in FIG. 7(A), the image may be changed to the inching selection image shown in FIG. 7(B).

In order to set the number of inching times for all the needle bars using the inching selection image of FIG. 7(A), the operator may press one of the displayed items "4 Times" to "9 Times" that corresponds to the desired number of inching times, so that the radio button 56 next to the selected item may flash green. As a result, the same number of inching times can be set for all the needle bars. The inching times data may be stored in RAM 3.

In the inching selection image shown in FIG. 7(B), the "Individual Setting" mode is selected to set the number of inching times for each needle bar. In order to indicate that the "Individual Setting" mode has been selected, the radio button 54 next to the item "Each Needle Bar" may flash green. If the operator selects the item "All Needle Bars" in the inching selection image shown in FIG. 7(B), the image may be changed to the inching selection image shown in FIG. 7(A).

In order to set the number of inching times for all the needle bars using the inching selection image of FIG. 7(B), the operator may select one of the needle bars using arrow key 60 or 61, so that one of the numerals "4" to "9," which represents the number of inching times and is positioned below the numeral (one of "1" to "9) identifying the selected needle bar, may be highlighted. With the needle bar thus selected, the operator selects the desired number of inching times (i.e., one of numerals "4" to "9") using the corresponding keys of the alphanumerical key pad 30. This operation is repeated for all the needle bars, so that the number of inching times can be set individually for each needle bar. The inching times data thus set may be stored in the RAM 3.

3. Upper Thread Cutting Detection

If the upper thread is accidentally cut during the sewing operation, the embroidery operation will stop. Therefore, it is very desirable to detect when the upper thread has been cut. For this purpose, an upper thread feeding amount detector 28 may be provided. In general, in order to determine whether or not an upper thread has been cut, the moving distance of the upper thread during one stroke of the needle bar 15 (for forming one stitch) may be used. For, example, if the detected moving distance is zero, the upper thread may possibly have been cut. The actual stroke length of the needle bar 15 may be determined based upon signals from the position detector 24. However, the moving distance of the upper thread during one stroke of the needle bar may vary with changes in properties of the upper thread or the fabric to be embroidered. In addition, if the selected embroidery pattern is changed or a special stitch is embroidered, such as "running stitch" or "satin stitch," the stroke length also may be different from usual stroke lengths. Therefore, in some cases, a determination as to whether the thread has been cut is preferably made only after the detected feeding amount of the upper thread is zero for a predetermined number of times of strokes. Preferably, the operator can set this predetermined number. For example, if the predetermined number is set to a high number, the cut detection sensitivity is reduced. On the other hand, if the predetermined number is set to a low number, the cut detection sensitivity is increased.

Therefore, in the representative embodiment, the number of strokes that are selected determines the detection sensitivity and will be referred to as "thread cutting detection sensitivity." Alternatively, the cutting of upper thread may be determined if the moving amount of the upper thread during the period after completion of one needle bar stroke and before starting of the next needle bar stroke is less than a predetermined value or zero. Thus, although the needle bar may not move during this period, an embroidery frame may move by a distance of one stitch to pull out the upper and lower threads.

Figure 8:
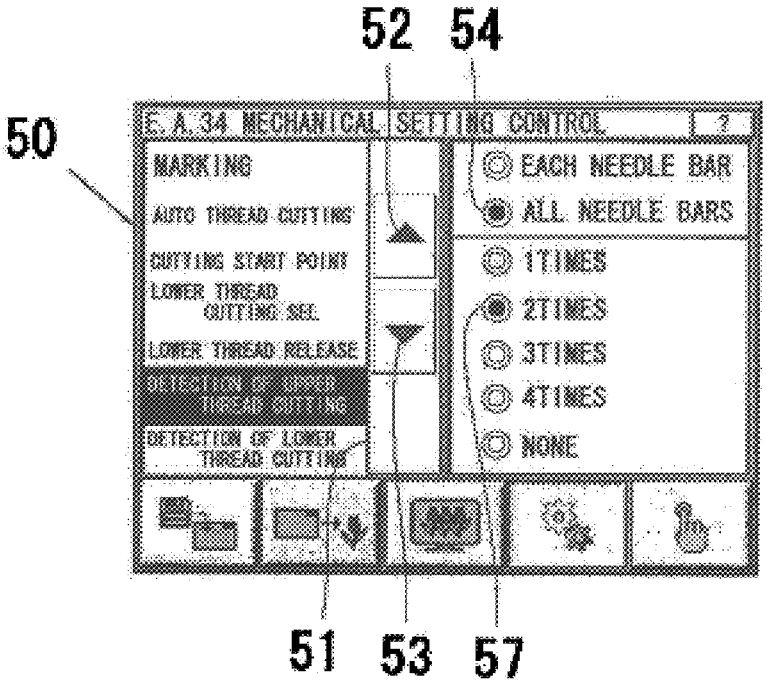
FIGS. 8(A) and 8(B) are views of representative images for a setting mode, in which a detection accuracy of an unintentional cut an upper thread can be set.
Figure 8:
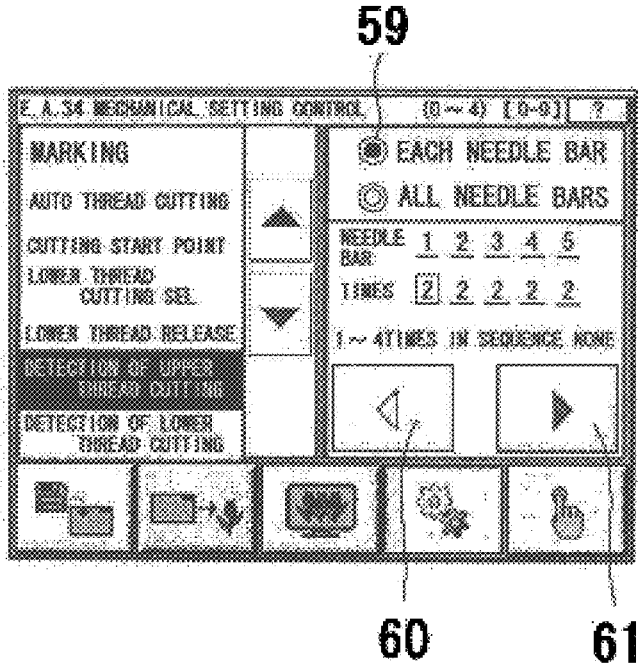

In order to set the upper thread cutting detection sensitivity, the operator may scroll through the "Menu Selection" area 50 shown in FIG. 5 until the item "Upper Thread Cutting Detection" is displayed in the "Initial Setting" image. By selecting or pressing the item "Upper Thread Cutting Detection", the image may be changed to the "Upper Thread Cutting Detection" image as shown in FIG. 8(A) or 8(B). The term "Upper Thread Cutting Detection" may be highlighted to indicate the selection of this term.

In "Upper Thread Cutting Detection" image shown in FIG. 8(A), the "Common Setting" mode has been selected in order to set the same number of strokes for upper thread cut detection for all the needle bars. In order to indicate that the "Common Setting" mode has been selected, the radio button 54 next to the item "All Needle Bars" may flash green. In addition, various other settable numbers may be displayed. In the representative embodiment shown in FIG. 8(A), "1 Time," "2 Times," "3 Times," "4 Times," and "None" may be displayed with corresponding radio buttons 57. Naturally, the radio button 57 that corresponds to the selected number of times may flash green. If "None" has been selected, upper thread cutting detection will not be performed. In the image shown in FIG. 8(A), "2 Times" is selected and the corresponding radio button 57 flashes green. If the operator selects the item "Each Needle Bar" in the "Upper Thread Cutting Detection Setting" image shown in FIG. 8(A), the image may be changed to the "Upper Thread Cutting Detection Setting" image shown in FIG. 8(B).

In order to set the number of times for detection for all the needle bars using the "Upper Thread Cutting Detection Setting" image of FIG. 8(A), the operator may press one of the displayed items "None" to "4 Times", respectively, so that the radio button 57 next to the selected item may flash green. As a result, the same number of times can be set for all the needle bars. The data representing the selected number of times for detection may be stored in RAM 3.

In the "Upper Thread Cutting Detection Setting" image shown in FIG. 8(B), the "Individual Setting" mode has been selected to set the number of times for detection for each needle bar. In order to indicate that the "Individual Setting" mode has been selected, the radio button 59 next to the item "Each Needle Bar" may flash green. If the operator selects the item "All Needle Bars" in the "Upper Thread Cutting Detection Setting" image shown in FIG. 8(B), the image may be changed to the "Upper Thread Cutting Detection Setting" image shown in FIG. 8(A).

In order to set the number of times for detection for each needle bar using the "Upper Thread Cutting Detection Setting" image of FIG. 8(B), the operator may use arrow key 60 or 61 to select one of the needle bars. In that case, one of the numerals "0" to "4" representing the number of times and positioned below the numeral (one of "1" to "9) identifying the selected needle bar may be highlighted. While a particular needle bar is selected, the operator uses alphanumerical key pad 30 to select a desired number of times for detection (i.e., one of numerals "0" to "4"). This operation is repeated for all the needle bars, so that the number of times can be set individually for each needle bar. The data representing the number of times for detection thus set may be stored in the RAM 3.

4. Lower Thread Cutting Detection

If a lower thread has been cut, the sewing operation must stop. Therefore, it is necessary to detect the unintentional cutting of the lower thread. In order to determine whether the lower thread has been cut, a lower thread moving distance detector may be provided. In the same manner as the upper thread cutting detection, the cutting of the lower thread may be determined if the moving distance of the lower thread during one stroke of the needle bar is less than a predetermined value. In addition, the upper thread feeding amount detector 28 may also be used for determining whether or not the lower thread has been cut. Preferably, the detection of cutting of the lower thread is performed at a different time than the time at which upper thread cutting detection is performed. In order to determine whether the lower thread has been cut using the upper thread feeding amount detector 28, the distance of movement or the amount of consumption of the upper thread may be calculated from the stitch data of the pattern to be embroidered. This calculated amount may be compared with an actual distance of movement or an actual amount of consumption of the upper thread. If the actual distance is less than the calculated distance, CPU 1 may determine that the lower thread has been cut. However, this determination usually cannot be accurately made based on the result of comparison with respect to only one stitch. In addition, different stitch forms may consume different amounts of the upper thread. Therefore, in this representative embodiment, various ratios (percentages) may be set for the lower thread cutting detection. The detection sensitivity may increase as the ratio (percentage) increases.

Figure 9:
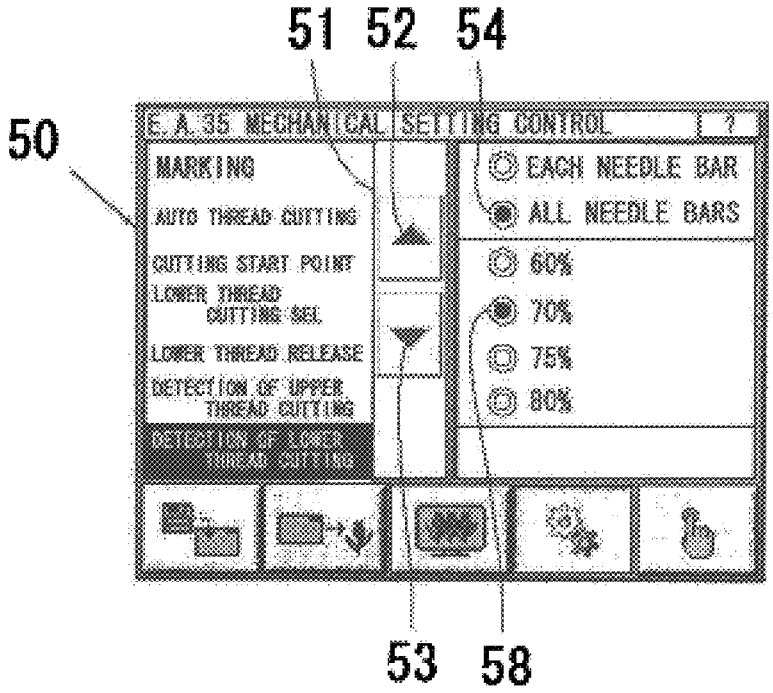
FIGS. 9(A) and 9(B) are views of representative images for a setting mode, in which a detection accuracy of an unintentional cut lower thread can be set.
Figure 9:
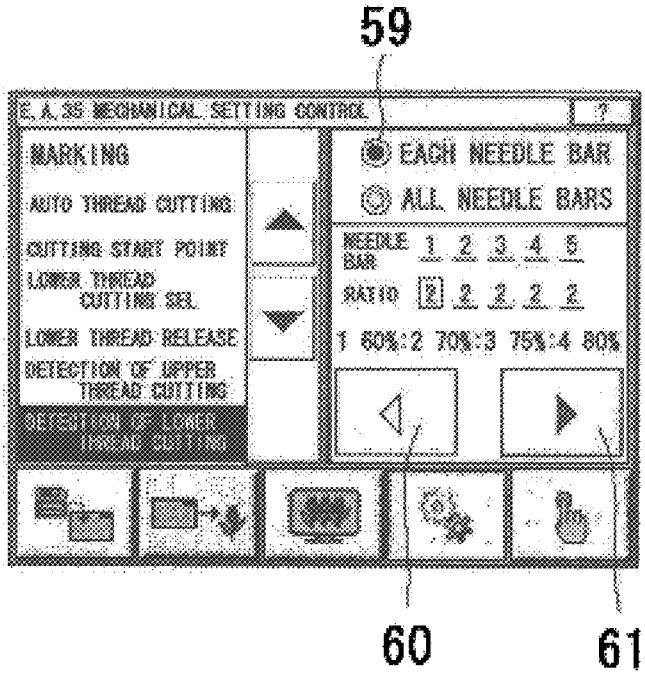

In order to set the lower thread cutting detection sensitivity, the operator may scroll through "Menu Selection" area 50 shown in FIG. 5 in order to display the item "Lower Thread Cutting Detection" in the "Initial Setting" image. By selecting or pressing this item, the image may be changed to "Lower Thread Cutting Detection" image as shown in FIG. 9(A) or 9(B). The item "Lower Thread Cutting Detection" may be highlighted to indicate the selection of this item.

In the "Upper Thread Cutting Detection" image shown in FIG. 9(A), the "Common Setting" mode has been selected in order to set the same detection ratio for all the needle bars. In order to indicate that the "Common Setting" mode has been selected, the radio button 54 next to the item "All Needle Bars" may flash green. In addition, various ratio values (percentages) may be displayed. In the representative embodiment shown in FIG. 9(A), "60%," "70%," "75%" and "80" may be displayed with corresponding radio buttons 58. Again, the radio button 58 that corresponds to the selected number of times may flash green. In the image shown in FIG. 9(A), "70%" has been selected, so that its related radio button 58 flashes green. If the operator selects the item "Each Needle Bar" in the "Lower Thread Cutting Detection Setting" image shown in FIG. 9(A), the image may be changed to the "Lower Thread Cutting Detection Setting" image shown in FIG. 9(B).

In order to set the same detection ratio for all the needle bars using the "Lower Thread Cutting Detection Setting" image of FIG. 9(A), the operator may press one of the displayed items "60%", "70%", "75%" and "80%", so that the radio button 58 next to the selected item may flash green. As a result, the same detection ratio can be set for all the needle bars. The set data representing the detection ratio may be stored in RAM 3.

In the "Lower Thread Cutting Detection Setting" image shown in FIG. 9(B), the "Individual Setting" mode has been selected in order to set the detection ratio for each needle bar. In order to indicate that the "Individual Setting" mode has been selected, the radio button 59 next to the item "Each Needle Bar" may flash green. If the operator selects the item "All Needle Bars" in the "Lower Thread Cutting Detection Setting" image shown in FIG. 9(B), the image may be changed to the "Lower Thread Cutting Detection Setting" image shown in FIG. 9(A).

In order to set the detection ratio for each needle bar using the "Lower Thread Cutting Detection Setting" image of FIG. 9(B), the operator may use arrow key 60 or 61 to select one of the needle bars. In that case, one of the numerals "1" to "4" representing the detection ratio and positioned below the numeral (one of "1" to "9) identifying the selected needle bar may be highlighted. With the needle bar thus selected, the operator uses the alphanumerical key pad 30 to input the desired percentage (i.e., the operator selects one of numerals "1" to "4" that represents the detection ratios). This operation is repeated for all the needle bars, so that the detection ratio can be set individually for each needle bar. The data representing the detection ratio thus set may be stored in the RAM 3.

Upon actuation of a start key, the CPU 1 starts to perform various controls, such as rotating the main motor 22, selecting one needle bar among all the needle bars 15, moving the embroidery frame 16 and driving the thread cutting device 36, based on the embroidery program stored in the ROM 2 and the various set data and operating conditions stored in the RAM 3. The control of "Upper Thread Cutting Length," "Start Inching After Thread Cutting," "Upper Thread Cutting Detection" and "Lower Thread Cutting Detection" during the sewing operation may be performed by reading out the data concerning the operating conditions stored in the RAM 3. More specifically, if the operating conditions were set using the "Common Setting" mode, the corresponding set data is read out from the RAM 3. On the other hand, if the operating condition were set using the "Individual Setting" mode, specific data set for the selected needle bar 15 may be read out from the RAM 3.

Figure 11:
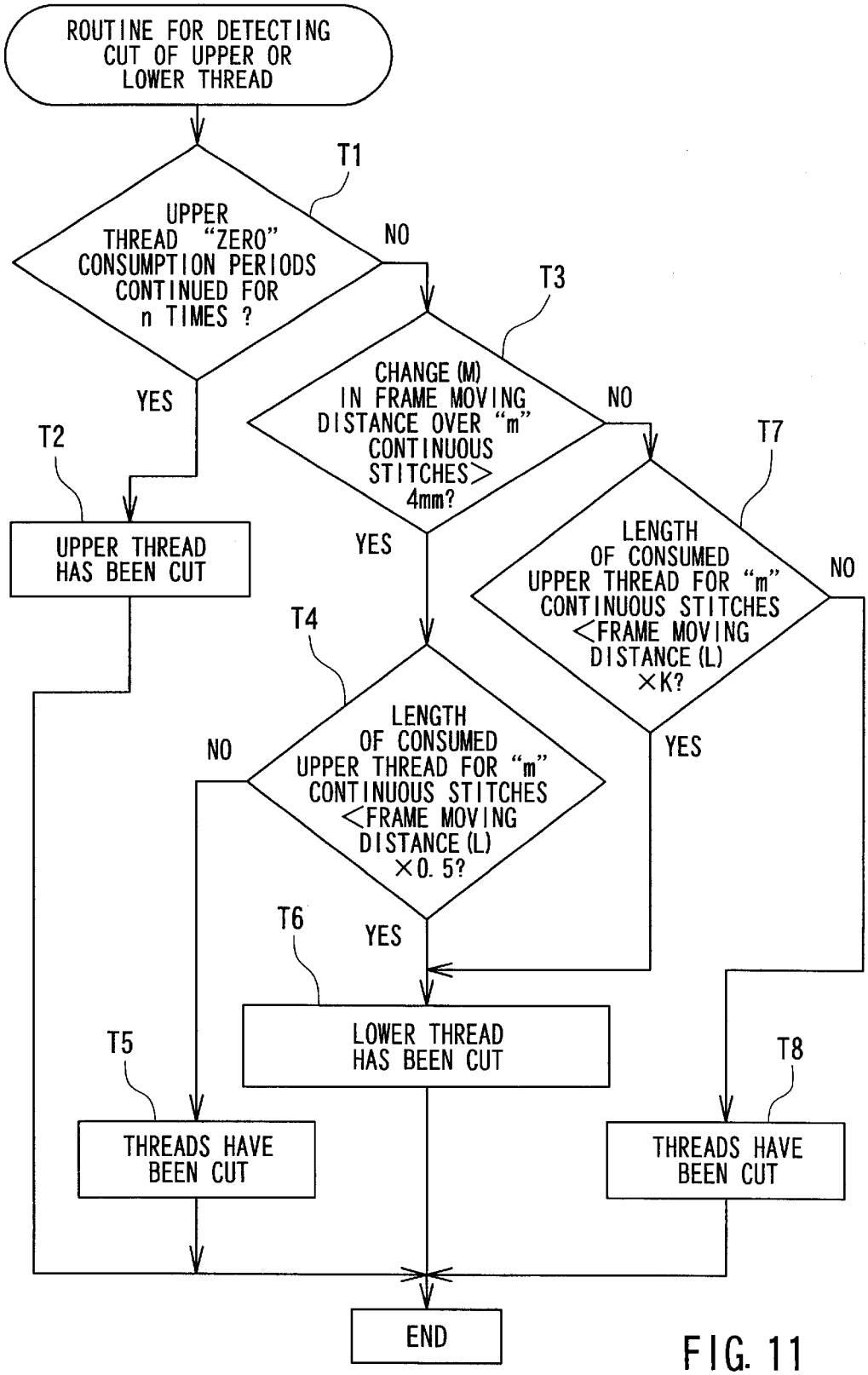
FIG. 11 is a representative flowchart illustrating a process for determining whether upper and lower threads have been unintentionally cut.

A representative process for detecting the cutting of an upper thread and a lower thread using the upper thread feeding amount detector 28 will now be described in detail with reference to the representative flowchart shown in FIG. 11. The process of FIG. 11 may be started at any appropriate time during the embroidering operation.

After the routine has been initiated, CPU 1 determines whether or not a "zero" consumption period has continued for "n" times (Step T1). In this specification, a "zero" consumption period means a period of time in which the actual consumption (actual moving distance) of the upper thread during one stroke of the needle bar 15 is zero. The value of "n" may be selectively determined (for example, among 1 to 4 times) according to the properties of the upper thread.

If the determination in Step T1 is YES, the process proceeds to Step T2 as it has been determined that the upper thread has been cut.

If the determination in Step T2 is NO, the process proceeds to Step T3 in which the CPU 1 determines whether or not a change in moving distance (M) is longer than 4 mm. In this case, the moving distance is the distance that the embroidery frame 16 moves during "m" continuous stitches. The change M may be a difference between the moving distance at the time of carrying out the step and the moving distance at the time just prior to carrying out the step. For example, if "m" is 4 and the embroidery frame 16 has moved to position (needle inserting position) p, a moving distance X from position p to position p+3 via position p+1 and position p+2 and a moving distance Y from position p−1 to position p+2 via position p and position p+1 may be calculated. Then, the difference or change M between the moving distance X and the moving distance Y may be calculated and may be compared to a set value (in this case, 4 mm). The distances X and Y may be calculated from the stored stitch data. The value of "m" may be selected according to the properties of the thread and may be selected, for example, among "2," "4," "6" and "8" stitches.

If the determination in Step T3 is YES, the process proceeds to Step T4 in which the CPU 1 determines whether or not the actual consumption (moving distance) of the upper thread during the "m" continuous stitches of the needle bar 15 is less than the amount:

[Moving distance calculated from the stitch data (L)×0.5].

If the determination in Step T4 is YES, the process proceeds to Step T6, because it has been determined that the lower thread has been cut. If the determination in Step T4 is NO, the process proceeds to Step T5, because it has been determined that the thread has not been cut.

If the determination in Step T3 is NO, the process proceeds to Step T7 in which the CPU 1 determines whether or not the actual consumption (moving distance) of the upper thread during the "m" continuous stitches of the needle bar 15 is less than [L×K]. The value "K" may be suitably selected according to the properties of the upper thread and may be selected, for example, from among "50%," "60%," "70%" and "80%".

If the determination in Step T7 is YES, the process proceeds to Step T6, because CPU 1 has determined that the lower thread has been cut. If the determination in Step T7 is NO, the process proceeds to Step T8, because CPU1 has determined that the thread has not been cut.

Figure 12:
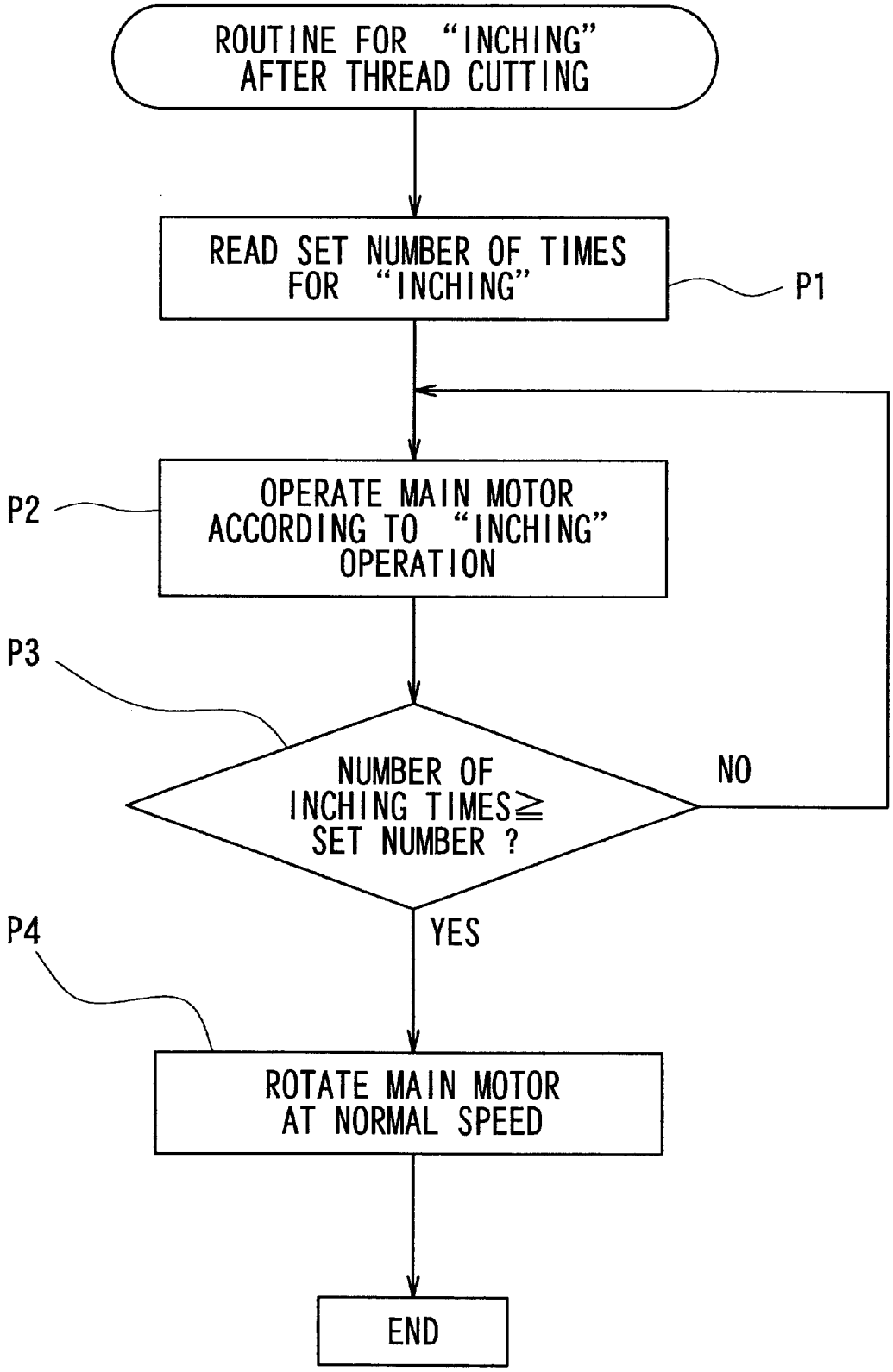
FIG. 12 is a representative flowchart illustrating a process for inching the needle bars after an upper thread has been cut.

A representative process for starting the "inching" operation for the needle bar 15 after thread cutting will now be described in detail with reference to the representative flowchart shown in FIG. 12. The process of FIG. 12 may be started when the needle bar is restarted after the thread has been cut.

After the routine has been initiated, CPU 1 reads out the preset number of times that the inching operations will be performed, which data is stored in the RAM 3 (Step P1). More specifically, if the inching operation was set using the "Common Setting" mode, the corresponding set data is read out from the RAM 3. On the other hand, if the inching operation data was set using the "Individual Setting" mode, a specific data set for the selected needle bar 15 may be read out from the RAM 3.

The process then proceeds to Step P2 in which the main motor 22 is started and rotates at a speed for the inching operation of the needle bar, which speed is less than the usual operating speed.

The process further proceeds to Step P3 in which the CPU determines whether or not the number of inching times of the needle bar has reached the set number. If the determination in Step P3 is NO, the inching operation continues. If the determination in Step P4 is YES, the process proceeds to Step P4.

In Step P4, the inching operation is discontinued and the main motor 22 rotates at the normal rotational speed.

Figure 13:
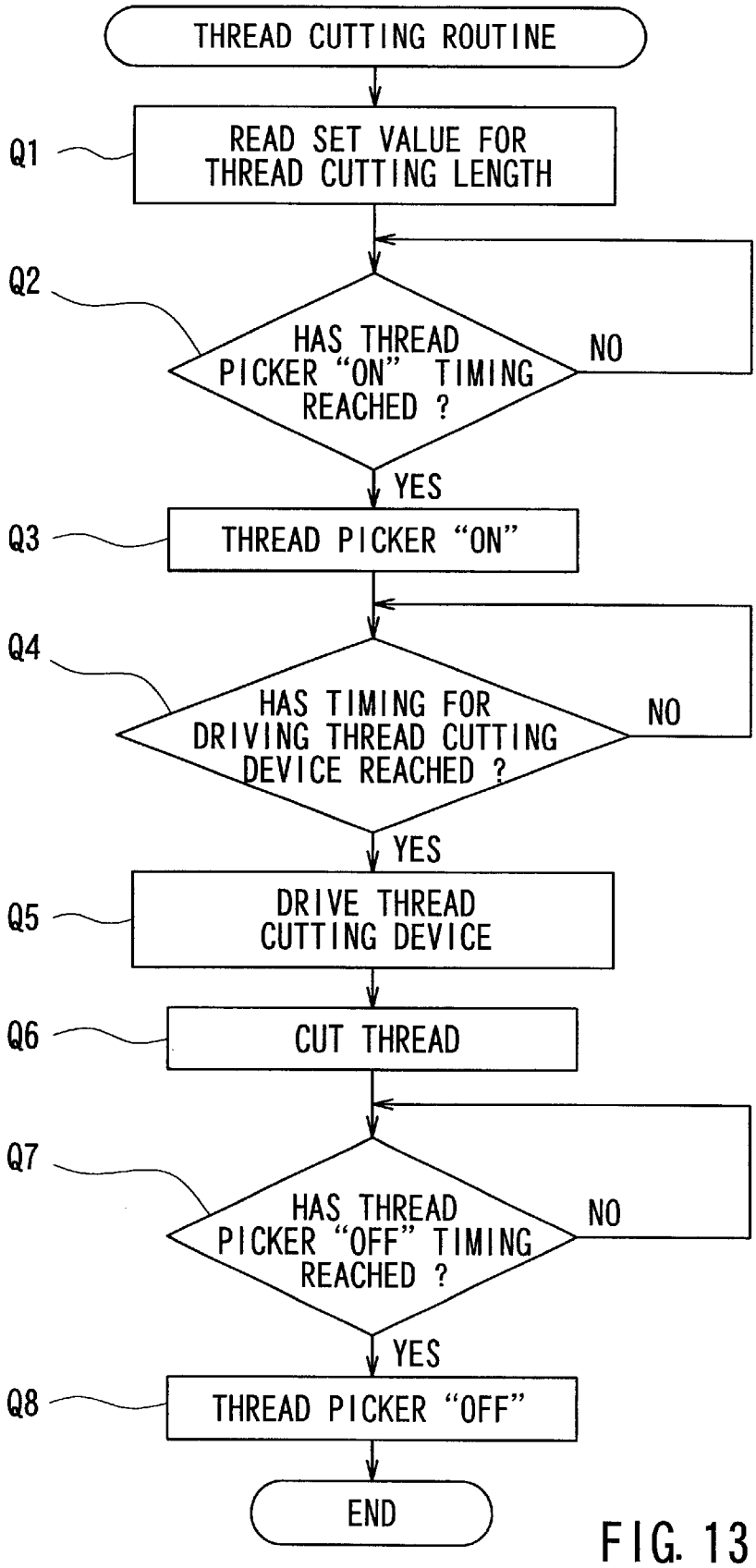
FIG. 13 is a representative flowchart illustrating a thread cutting process.

A representative process for cutting the upper thread and/or the lower thread will now be described in detail with reference to a flowchart shown in FIG. 13. The process of FIG. 13 may be started when the thread will be cut after completion of the sewing operation.

After the routine is initiated, CPU 1 reads out the cutting length that has been set and stored in the RAM 3 (Step Q1). More specifically, if the cutting length was set using the "Common Setting" mode, the corresponding set data is read out from the RAM 3. On the other hand, if the cutting length was set using the "Individual Setting" mode, a particular data set for the selected needle bar 15 may be read out from the RAM 3. As previously described, the cutting length may be varied by changing the timing of movement of the thread picker away from the shuttle. Therefore, the set value may represent such timing of movement of the thread picker (referred to as "OFF" timing of thread picker in Step Q7).

The process then proceeds to Step Q2 in which the CPU 1 determines whether or not the time for moving the thread picker toward the shuttle (hereinafter called "ON" timing) has reached. If the determination in this step is NO, the CPU 1 waits until the "ON" timing is reached. If the determination in this step is "YES," the process proceeds to Step Q3 in which the thread picker is moved toward the shuttle or the thread picker becomes "ON."

After Step Q3, the process proceeds to Step Q4 in which the CPU 1 determines whether or not the timing for driving the thread cutting device 26 has reached. If the determination in this step is NO, the CPU waits until the timing for driving the thread cutting device 26 is reached. If the determination in this step is YES, the process proceeds to Step Q5 in which the thread cutting device is started. The thread may be cut in Step Q6.

Step Q6 follows Step Q7 in which the CPU 1 determines whether or not the timing for moving the thread picker away from the shuttle (hereinafter called "OFF" timing) has reached. If the determination in this Step is NO, the CPU 1 waits until the OFF timing is reached. If the determination is YES, the process proceeds to Step Q8 to move the thread picker away from the shuttle.

Although the above preferred embodiment has been described in connection with an embroidery machine, the present invention may be applied to any kind of sewing machine. In addition, although ROM and RAM have been used as memory devices, a single memory device can be used to store the data. Further, other types of memory devices may suitably be used. Finally, the present invention may also be applied to a sewing machine that has one sewing head or a number of sewing heads other than four.

What is claimed is:

1. A sewing machine comprising:

a sewing head having a plurality of needle bars;

a controller constructed and arranged to select one needle bar at a time from the plurality of needle bars to perform an embroidery operation; and a memory device storing a plurality of operating programs and a plurality of operating conditions for the sewing machine, the memory device further storing a plurality of operating conditions for each of the plurality of needle bars whereby each needle bar may be operated using a different set of operating conditions from each other needle bar, wherein the controller executes the operating programs using the plurality of operating conditions stored for each selected needle bar in order to perform the embroidery operation according to specific operating conditions set for each selected needle bar.

2. A sewing machine as in claim 1, wherein the operating conditions for each respective needle bar comprise at least one operating condition selected from the group consisting of thread cutting length, start inching, number of inching times, upper thread cutting detection and lower thread cutting detection.

3. A sewing machine as in claim 1, wherein the memory device stores at least one operating parameter for use with the plurality of operating programs selected from the group consisting of jump convert, auto jump, satin stitch, high rotational speed, low rotational speed, method of frame leaping, auto origin return, start timing of movement of frame, start inching, start inching after thread cutting.

4. A sewing machine as in claim 1 further including an operator interface enabling an operator to set the plurality of operating conditions for each respective needle bar, the operator interface having an individual setting mode that permits the operator to input individually selected operating conditions for each of the plurality of needle bars, the operating conditions being stored in the memory device as operating conditions corresponding to the respective needle bars.

5. A sewing machine as in claim 4, wherein the operator interface comprises a display that displays a menu selection area having a plurality of items corresponding to a plurality of operating conditions, wherein the display displays an image corresponding to the individual setting mode.

6. A sewing machine as in claim 5, wherein the operator interface displays the individual setting image with identifications representing the respective needle bars and the identification of operating conditions that have been individually and previously set for each needle bar.

7. A sewing machine comprising:

a sewing head having a plurality of needle bars comprising at least a first needle bar and a second needle bar:

a controller programmed to select one needle bar at a time from the plurality of needle bars to perform an embroidery operation, an operator interface inputting operating conditions to the controller for the respective needle bars; and a memory storing a plurality of operating programs and a plurality of operating conditions to be executed by the controller in order to operate the sewing machine, wherein the operator interface, the controller and the memory device receive operating conditions for the first needle bar that differ from the operating conditions for the second needle bar, and wherein the needle bars are operated using the differing operating conditions.

8. A sewing machine as in claim 7, wherein the operating conditions for each respective needle bar comprise at least one operating condition selected from the group consisting of thread cutting length, start inching, number of inching times, upper thread cutting detection and lower thread cutting detection.

9. A sewing machine as in claim 8, wherein the memory stores at least one operating parameter for use with the operating programs selected from the group consisting of jump convert, auto jump, satin stitch, high rotational speed, low rotational speed, method of frame leaping, auto origin return, start timing of movement of frame, start inching, and start inching after thread cutting.

10. A sewing machine as in claim 8, wherein the operator interface has an individual setting mode that permits the operator to input individually selected operating conditions for each of the plurality of needle bars, the operating conditions being stored in the memory as operating conditions corresponding to the respective needle bars.

11. A sewing machine as in claim 10, wherein the operator interface comprises a display that displays a menu selection area having a plurality of items corresponding to the plurality of operating conditions, wherein the display displays an image corresponding to the individual setting mode.

12. A sewing machine as in claim 10, wherein the operator interface displays the individual setting image with identifications representing the respective needle bars and the identification of operating conditions that have been individually and previously set for each needle bar.

13. A sewing machine comprising:

a sewing head having a plurality of needle bars; and a control unit comprising a controller programmed to select one needle bar at a time from the plurality of needle bars to perform an embroidery operation, an operator interface inputting operating conditions to the controller for the respective needle bars, and a memory storing a plurality of operating programs for the sewing machine, wherein the control unit has a common setting mode and an individual setting mode, wherein in the common setting mode, data representing operating conditions that are identical for each of the plurality of needle bars are stored in the memory and in the individual setting mode, data representing operating conditions that differ for each of the plurality of needle bars are stored in the memory, wherein the control unit operates the plurality of needle bars using the plurality of operating conditions stored in the memory device.

14. A sewing machine as in claim 13, wherein the operating conditions for each respective needle bar comprise at least one operating condition selected from the group consisting of thread cutting length, start inching, number of inching times, upper thread cutting detection and lower thread cutting detection.

15. A sewing machine as in claim 13, wherein the memory stores at least one operating parameter for use with the operating programs selected from the group consisting of jump convert, auto jump, satin stitch, high rotational speed, low rotational speed, method of frame leaping, auto origin return, start timing of movement of frame, start inching, and start inching after thread cutting.

16. A sewing machine as in claim 13, wherein the operator interface comprises a display that displays a menu selection area having a plurality of items corresponding to the plurality of operating conditions, wherein the display displays an image corresponding to the common setting mode and an image corresponding to the individual setting mode.

17. A sewing machine as in claim 16, wherein the operator interface displays the common setting image with identifications representing all the needle bars and displays the individual setting image with identifications representing the respective needle bars and the identification of operating conditions that have been individually and previously set for each needle bar.

18. A sewing machine as in claim 17 wherein the individual setting image for the operating conditions includes an operator selectable identification of an item of the common setting mode and an item of individual setting mode, wherein the common setting image is displayed when the common setting mode identification is selected and the individual setting image is displayed when the individual setting mode identification is selected.

19. A sewing machine as in claim 18, wherein the operating conditions are selected from the group consisting of thread cutting detection, number of inching times and thread cutting length.

20. A method of controlling operation of a sewing machine having a plurality of needle bars, each needle bar having a thread, comprising storing in memory a separate set of sewing operation instructions for each needle bar according to thread characteristics of the thread of that needle bar, wherein the threads of the needle bars having differing thread characteristics;

adjusting sewing operation of each needle bar in accordance with the separate set of sewing operating instructions for that needle bar.

21. A method as in claim 20, wherein the thread characteristics are selected from the group consisting of thickness, smoothness and elasticity.

22. A method as in claim 20, wherein the needle bar operation instructions are selected from the group consisting of thread cutting detection, number of inching times and thread cutting length.

23. A method of operating at least two needle bars disposed on a sewing machine head, each needle bar retaining a thread and the threads having different thread characteristics other than color, comprising:

storing in memory an individualized set of needle bar operating instructions for each of the at least two needle bars, the needle bar operating instructions for each needle bar being selected according to non-color thread characteristics of the thread, retained by the needle bar such that the stored needle bar operating instructions are different for the threads having different thread characteristics and executing the stored needle bar operating instructions for the at least two needle bars.

24. A sewing machine comprising:

a sewing head having at least two needle bars, wherein at least two different threads are disposed on the respective at least two needle bars, the threads differing by a physical characteristic other than color;

a controller adapted to select one needle bar to perform an embroidery operation; and a memory device storing a plurality of operating programs and a plurality of operating conditions for the sewing machine, the memory device further storing a plurality of operating conditions for each needle bar, wherein different operating conditions are stored for needle bars having threads that differ in a non-color physical characteristic, each needle bar is operable using a different set of operating conditions from each other needle bar, wherein the controller executes the operating programs using the plurality of operating conditions stored for each selected needle bar in order to perform the embroidery operation according to the specific operating conditions set for each selected needle bar.

* * * * *